United States Patent [19]

Carlsson et al.

[11] Patent Number: 4,756,225

[45] Date of Patent: Jul. 12, 1988

[54] KEYBOARD OF PIANOS AND SIMILAR KEY INSTRUMENTS

[76] Inventors: Lars G. Carlsson, Klarbarsvagen 2, S-591 50 Motala; Staffan Sjostrand, Box 2112, S-600 02 Norrkoping, both of Sweden

[21] Appl. No.: 933,224

[22] PCT Filed: Jan. 17, 1986

[86] PCT No.: PCT/SE86/00014

§ 371 Date: Nov. 6, 1986

§ 102(e) Date: Nov. 6, 1986

[87] PCT Pub. No.: WO86/04442

PCT Pub. Date: Jul. 31, 1986

[30] Foreign Application Priority Data

Jan. 17, 1985 [SE] Sweden ..... 8500218

[51] Int. Cl.[4] ..... G10C 3/12

[52] U.S. Cl. ..... 84/434

[58] Field of Search ..... 84/423, 430–438

[56] References Cited

U.S. PATENT DOCUMENTS 3,456,545 7/1969 Kondo ..... 84/435
3,499,362 3/1970 Harada ..... 84/434

FOREIGN PATENT DOCUMENTS 1772165 9/1977 Fed. Rep. of Germany .
3020867 3/1982 Fed. Rep. of Germany .
2758695 4/1982 Fed. Rep. of Germany .

*Primary Examiner*—Benjamin R. Fuller
*Attorney, Agent, or Firm*—Spencer & Frank

[57] ABSTRACT

A keyboard of pianos and similar key instruments which has a keyboard frame and a plurality of key arms which are mounted in the keyboard frame in such a way that the key arms only can swing in a plane that is perpendicular to the plane of the keyboard frame. The keyboard frame consists of metal and a vibration absorbing material is arranged between the bearing mechanisms on the key arms and the keyboard frame. This will make the manufacture of the keyboard cheaper and reduce the need of readjustments of the keyboard. The vibration absorbing material is provided in grooves in the keyboard frame, and the bearing means, which can consist of pins are fastened in the vibration absorbing material.

8 Claims, 2 Drawing Sheets

KEYBOARD OF PIANOS AND SIMILAR KEY INSTRUMENTS

BACKGROUND OF THE INVENTION

1. Field of the Invention

The present invention relates to a keyboard of pianos and similar key instruments, for example grand pianos and harpsichords. The keyboard comprises a keyboard frame and a plurality of key arms arranged on bearing means in the keyboard frame in such a way that the key arms can be swinged only in a plane that is perpendicular to the plane of the keyboard frame.

2. Discussion of the Prior Art

For the present, keyboards of pianos and similar key instruments are manufactured substantially of wood. The keyboard frame as well as the key arms require a special kind of wood and a special pretreatment of the wooden pieces to be used. The key arms are sawed one after another from a carefully shaped key arm beam. This manufacturing method has several considerable disadvantages. First, the manufacturing is expensive, because a substantial effort of manual work is required for readjustment of pins and other bearings and of the key positions and this time consuming work has to be done by skilled craftsmen. Second, in spite of all the care taken during the manufacturing, the wooden pieces are affected during transportation and storing which makes further adjustments necessary in connection with the delivery to the purchaser. Third, the wooden pieces are affected by variations in temperature and air moisture which makes continuous adjustments necessary during the life of the keyboard.

SUMMARY OF THE INVENTION

The main object of the present invention is to provide a keyboard design that substantially completely eliminates the above mentioned disadvantages, thus considerably reducing the manufacturing costs and the need of continuous maintenance.

Due to the fact that the keyboard frame consists of metal, the risk of successive changes during a possible storing time as well as during the life is eliminated. This obviates substantially the need of adjustments when the instrument in which the keyboard is adapted is delivered, and during the life of the instrument. However, the use of metal in the keyboard frame causes difficult resonance effects and disturbing extraneous noise when the keys of the keyboard are pushed down and released. These disadvantages are avoided by positioning a vibration absorbing material between the bearing means of the key arms and the keyboard frame. Due to the fact that the vibration absorbing material is provided in grooves in the keyboard frame an improved manufacturing accuracy is obtained, particularly if the bearing means of the key arms are fastened directly in the vibration absorbing material, as well as a substantial stabilization of the vibration absorbing material.

In prior keyboards each key arm is mounted on two vertical pins, one of which, the balance rail pin, being provided at a certain distance from the front end of the key arm and the other, the front rail pin, being provided at the front end of the key arm. The balance rail pins and the front rail pins of the separate key arms form pin rows usually running substantially perpendicularly to the front portions of the key arms. Due to the fact that the keyboard frame is provided with two elongated grooves for the vibration absorbing material, one groove being provided for the balance rail pins and the other groove being provided for the front rail pins, and the balance rail pins and front rail pins are fastened directly in the vibration absorbing material in the pertaining grooves, the manufacturing is very simple. At the same time a very high accuracy can be obtained. The continuous, elongated blocks of vibration absorbing material also provide a very efficacious damping of the vibrations, so that no disturbing resonances or extraneous noise arise when the keys are touched.

Due to the fact that the keyboard frame consists of metal and vibration absorbing material is provided between the bearing means of the key arms and the keyboard frame, the keyboard frame forms a rigid unit which can be moved laterally, i.e. perpendicularly to the longitudinal direction of the keys. This feature will make it possible to change the key of the instrument easily.

Due to the fact that each key arm is built on a metal section, particularly a hollow section, the manufacturing costs of the key arms are substantially reduced at the same time as the accuracy is improved and the need of readjustments is brought to a minimum.

BRIEF DESCRIPTION OF DRAWINGS

The keyboard according to the invention will now be further described below with reference to the accompanying drawings.

DESCRIPTION OF THE PREFERRED EMBODIMENTS

Figure 1:
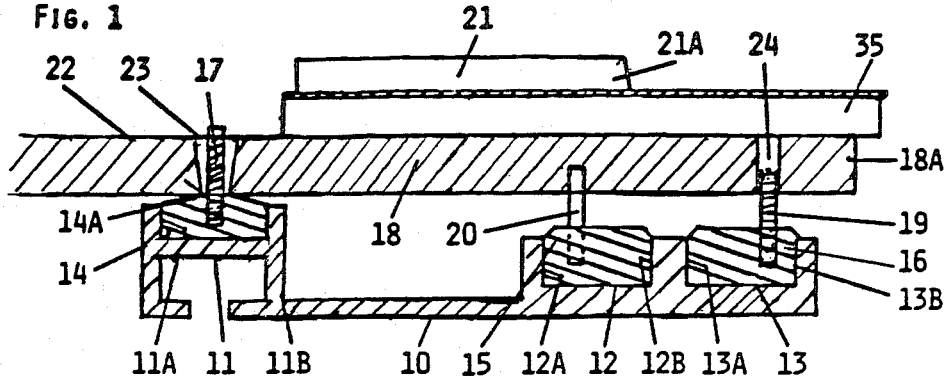
FIG. 1 is a cross section of a keyboard of a piano with a keyboard frame and the front portion of a key arm.

The keyboard frame 10 shown in FIG. 1 consists of an extruded aluminium section having three parallel grooves 11, 12 and 13. Each one of these grooves is provided with a strand 14,15,16, respectively, of a vibration absorbing material. The strand runs in the groove substantially along its entire length. The strands 14–16 have a height so that they project to some extent over the top edges of the walls 11A,11B,12A,12B,-13A,13B, respectively, limiting the grooves 11–13. The balance rail pins of the lower keys, normally white, and the upper keys, normally black, are fastened in the strand 14 in the groove 11. However, FIG. 1 only shows one balance rail pin 17 for a key arm 18 of a lower key. The front rail pins of the lower keys are fastened in the strand 16 in the groove 13. However, the figure only shows one pin 19 of the key arm 18. The front rail pins of the upper keys are fastened in the strand 15 in the groove 12. Also in this case only one pin 20 is shown which is provided for the key arm of the upper key 21 lying behind the key arm 18.

The balance rail pins 17 and the front rail pins 19 and 20 are fastened in the vibration absorbing material, either by making holes in the vibration absorbing material and then forcing the pins into these holes or by casting the pins into the material. The vibration absorbing material can be prepared in advance in the shape of mouldings or can be cast directly into the grooves 11–13 of the keyboard frame.

The longitudinal upper edges of the strands 14–16 are bevelled, the strand 14 for the balance rail pins being so heavily bevelled that the upper face of the strand forms a narrow ridge 14A under the key arm 18.

The lower face of the key arm 18 abuts the strand 14 of vibration absorbing material in the groove 11 and is provided with a circular hole 22 into which the pin 17 penetrates. The upper face of the key arm is provided with an oblong hole 23 which has its longer direction in the longitudinal direction of the key arm and through which the pin 17 projects. The two holes 22 and 23 form the end surfaces of a conical aperture through the key arm. The front end 18A of the key arm 18 is further provided with a hole 24, into which the front rail pin 19 penetrates. Thus, the key arm 18 can swing about the balance rail pin 17 in a plane that is perpendicular to the plane of the keyboard frame. The front rail pin is adapted to guide the key arm in this plane, so that the key arm cannot swing in the plane of the keyboard frame. The key arms of all keys, the upper keys as well as the lower keys, are mounted and guided in the same way. However, the key arms of the upper keys are shorter and their front rail pins are therefore positioned at a longer distance from the front edge of the keyboard frame. The disclosed guiding of the key arms belongs to the prior art and does not form any part of the present invention.

The strands 15 and 16 of the front rail pins are positioned somewhat lower than the strand 14 of the balance rail pins, as shown in FIG. 1, to enable depression of the key arms. Due to the fact that the strands 14–16 project over the side walls of the grooves, the key arms will not get into touch with the metal section of the keyboard frame, thus avoiding disturbing extraneous noise. The vibration absorbing material of the strands 15 and 16, respectively, of the front rail pins stops the downward movements of the key arms in a soft way and provides a fast return of the key arms to their initial positions.

As shown in FIG. 1, the balance rail pins 17 are positoned at a distance from the front ends of the key arms and the front rail pins 19,20 are positioned at the front ends 18A,21A of the key arms of the lower and upper keys, respectively.

Figure 2:
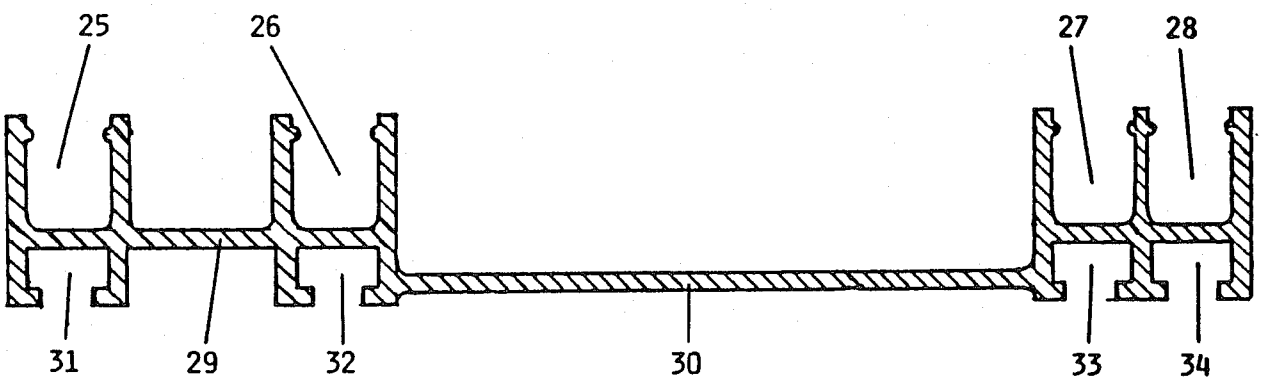
FIG. 2 is a cross section of a modified section of a keyboard frame.

FIG. 2 shows a modified design of an extruded aluminium section for a keyboard frame which can replace the section shown in FIG. 1. The section is shaped with four grooves 25–28, of which the grooves 25 and 26 are intended for vibration absorbing material of the balance rail pins, the balance rail pins of the lower and upper keys being provided in two separate rows instead of in one row as in the embodiment according to FIG. 1, and the grooves 27 and 28 are intended for vibration absorbing material of the front rail pins of the upper and lower keys, respectively. The grooves 27 and 28 are positioned adjacent each other, while the grooves 25 and 26 are spaced from each other. The portions in which the grooves 25 and 26 are provided are connected by means of a web 29, and the portion in which the grooves 27 and 28 are provided is connected to the portion in which the groove 26 is provided by means of a web 30. The grooves 25–28 have a U-shaped cross section, and the upper free edges of the side walls of the grooves are provided with rib-shaped projections running along the full length of the groove to hold the vibration absorbing material. Open pockets 31–34 are provided under the separate grooves, and the pockets have a narrow entrance and can be used as screw pockets for fastening the section in the music instrument in which the keyboard is to be installed.

Rubber, and preferably hard rubber, can be used as vibration absorbing material.

The key arm 18, shown in FIG. 1, is built on a metal section. The front end of the section is provided with an applied key 35 of conventional type. The metal section can preferably be a hollow section with a cross section having the shape shown in FIG. 3. This hollow section has a core 36 with a substantially square cross section and four flanges 37–40. The flanges 37, 38 are arranged to project upwards from the upper face of the core and the flanges 39,40 are arranged to project downwards from the lower face of the core. The flanges 37,38 are arranged to form a support for the applied key 35 which can be provided with slots for the flanges and can be cemented to the upper face of the hollow key arm 18. The free edges of the flanges 39,40 form two stop faces 39A,40A of the key arm which strike the vibration absorbing material of the front rail strand 16 when depressed and then to some extent penetrate into the vibratio absorbing material. This feature will provide a more comfortable touch for the piano-player. The flanges 37–40 further provide a substantial stiffening of the key arm.

Figure 4:
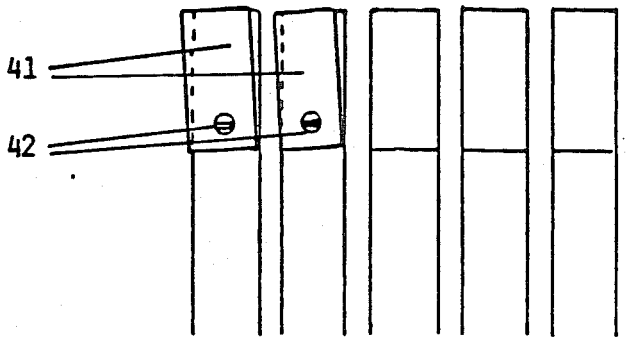
FIG. 4 is a diagrammatical view of key arms which are provided with laterally pivoting end elements at their rear ends.
Figure 3:
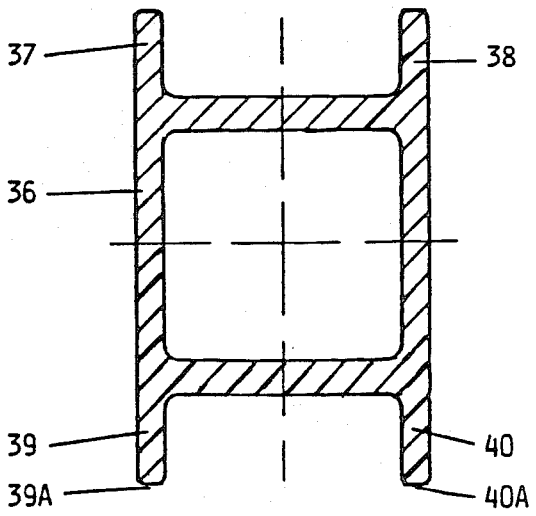
FIG. 3 is a cross section of an extruded section for the key arms.

The key arm design shown in FIG. 3 can be used in all keyboards. However, because most conventional pianos are cross-stringed, some of the key arms, particularly in the bass range, have to be bent to an angle. This is achieved according to the invention by providing the rear end of the key arm with a separate end piece 41, for example a plate, as diagramatically shown in FIG. 4. This end piece is mounted pivoting on the key arm by means of a locking screw 42. Thus, the end piece can be adjusted to form an angle with the key arm 18 by loosening the locking screw 42 and then turning the end piece laterally to a desired angle and then locking the end piece in this position by tightening the locking screw. The end piece can then be provided with a pilot of conventional type.

Due to the fact that the keyboard frame is shaped as a separate unit of metal, the keyboard can be moved laterally to enable a change of key of instrument easily.

While only a few embodiments of the keyboard according to the invention have been described above and shown on the drawings, it is evident that many variations and modifications are possible within the scope of the invention depending upon desiderata and range of use of the keyboard. It is not necessary that the keyboard frame consists of an extruded aluminium section, and the keyboard frame can be assembled, for example by welding or screwing, of several separate parts. These parts may also consist of other metals than aluminium. Also other materials than rubber, for example plastics or other cast compounds or materials providing a good vibration absorption can be used as vibration absorbing materials. The bearing means can alternatively be fastened in separate vibration absorbing elements, but this will make the manufacture more complicated.

The keyboard according to the invention is intended for stringed instruments having keys, such as pianos, grand pianos and harpsichords, and can be used in straight-stringed as well as in cross-stringed instruments. It is also possible that it can be used in other play-instruments having keyboards, for example organs and electronical music instruments.

We claim:

1. A keyboard for pianos and other similar key instruments having a set of key arms and comprising:

a keyboard frame having at least two elongate grooves, each said grooves being defined by two side walls such that said grooves have a substantially U-shaped cross section;

at least two strands of vibration absorbing material, each forming a continuous elongate block and being disposed in a respective one of said grooves;

a set of front rail pins, arranged in the strand of one of said grooves, there being a front rail pin for each respective key arm;

a set of balance rail pins arranged in the other strand of said grooves, there being a balance rail pin for each respective key arm;

each key arm having a lower face and a front end and being mounted in said keyboard frame on its respective front rail pin and balance rail pin, said balance rail pins being spaced from said front end and said front rail pins being provided at said front end such that each respective key arm can move in a plane perpendicular to the plane of said keyboard frame;

a portion of each strand extending above said side walls so that only said lower face of each key arm contacts any strand.

2. A keyboard as defined in claim 1, wherein said key arms have a longitudinal direction and said keyboard frame are movable in the plane of said keyboard frame perpendicularly to said longitudinal direction of said key arms thereby changing the key of the instrument.

3. A keyboard as defined in claim 1, wherein each said key arm includes a metal section.

4. A keyboard as defined in claim 3, wherein said metal section includes a means defining a hollow section and at least one stiffening flange attached to said hollow section defining means, said stiffening flange being disposed transverse to said longitudinal direction of said key arm.

5. A keyboard as defined in claim 4, wherein each said key arm further includes a key coating, and said metal section has an upper face containing two flanges adapted to penetrate into said key coating.

6. A keyboard as defined in claim 4, wherein said metal section has a lower face containing two flanges each having free ends, said free ends being adapted to strike said strands when said key arm is depressed.

7. A keyboard as defined in claim 3, wherein each said key arm has a rear end and at least one of said key arms further includes a laterally turnable end piece disposed at said rear end, said end piece being adjustable with respect to said respective key arm.

8. A keyboard as defined in claim 1, wherein said strand is composed of rubber.

* * * * *